US005647109A

United States Patent [19]

Steiner et al.

[11] Patent Number: 5,647,109

[45] Date of Patent: Jul. 15, 1997

[54] YARN TEXTURING DEVICE INCLUDING A STUFFER BOX CHANNEL WITH CIRCUMFERETIALLY CLOSED CROSS SECTION

[75] Inventors: Erwin Steiner, Clover, N.C.; Rolf Mischker, Fort Mill, S.C.

[73] Assignee: American Suessen Corporation, Charlotte, N.C.

[21] Appl. No.: 534,221

[22] Filed: Sep. 26, 1995

[51] Int. Cl.[6] ..... D02G 1/12

[52] U.S. Cl. ..... 28/263; 28/221

[58] Field of Search ..... 28/263, 264, 265, 28/221, 267

[56] References Cited

U.S. PATENT DOCUMENTS 2,854,728 10/1958 Rainard et al. ..... 28/267
5,419,923 5/1995 Hawkins et al. ..... 28/263
5,485,662 1/1996 Hodges, Jr. et al. ..... 28/263

FOREIGN PATENT DOCUMENTS

4243765A1 6/1994 Germany .
1020980 2/1966 United Kingdom ..... 28/263

*Primary Examiner*—Andy Falik
*Attorney, Agent, or Firm*—Evenson McKeown Edwards & Lenahan, PLLC

[57] ABSTRACT

A texturizing device for a yarn conditioning plant comprises a stuffer box, which is made from one piece. The cross section of the stuffer box channel is circular and predominantly constant; however, a taper and/or a yarn retarding lid can be arranged at the exit end of the stuffer box channel. In order to attain a crimping effect when the production is started, the stuffer box comprises at least one air inlet opening, which leads into the stuffer box channel, and which is directed against the channel inlet opening.

22 Claims, 2 Drawing Sheets

YARN TEXTURING DEVICE INCLUDING A STUFFER BOX CHANNEL WITH CIRCUMFERETIALLY CLOSED CROSS SECTION

BACKGROUND AND SUMMARY OF THE INVENTION

The present invention relates to a texturizing device for a yarn conditioning plant. This device comprises a pair of feed rollers for feeding at least one yarn to be crimped; a stuffer box that crimps the yarn, said stuffer box having a stuffer box channel, a channel inlet opening, and a channel outlet opening; and a conveyor for transporting the crimped yarn to a heat setting chamber.

Known texturizing devices of this kind (German published patent application 4,243,765) are used to stuff yarn mechanically in such a way that the yarn becomes crimped. The stuffing takes place in a stuffer box by exerting a retarding force on the continuously fed-in yarn, whereby the yarn is laid down in random loops in the stuffer box channel and accumulates. The accumulated yarn layers are gradually pushed out through the exit end of the stuffer box by the continuously fed-in yarn. The crimping of the yarn should be maintained after leaving the stuffer box for subsequent treatment. For this reason, the crimped yarn is fed by a transporting device continuously into a heat setting chamber, whereby the crimping is heat set. The crimped yarn is then used in the form of so-called frieze yarn for the production of various end products, such as carpets.

The practically used stuffer box comprising the known stuffer box channel is made from a plurality of housing parts. The cross section of the known stuffer box channel is rectangular. Single fibers or filaments might accumulate at the parting lines, and thus impair the crimping process. A similar shortcoming arises at the edges of the cross section.

An object of the present invention is to provide a stuffer box comprising a stuffer box channel which is operationally reliable.

This object has been achieved-in accordance with the present invention by applying a stuffer box channel which has a closed circular cross section free from any parting lines.

The novel stuffer box is made from one piece thus avoiding any parting lines. Because of the predominantly constant and circular cross section, there are no impairments based on any discontinuity surfaces.

In a preferable embodiment, the stuffer box channel is continuously cylindrical. If necessary, the stuffer box channel may be provided with a taper in the area of its outlet opening; thus a certain retarding force is effective so that the crimped yarn cannot lose its crimping. This retarding force may preferably be increased by providing a pivotable lid in the area of the outlet opening. The retarding force is effective against the movement of the yarn; it might be caused either by the weight of the lid itself or by an additional spring force.

In a further embodiment of the present invention the stuffer box comprises at least one air inlet opening, which leads into the stuffer box channel, and which is directed against the channel inlet opening. Thus a crimping effect is attained when the production is started. The air stream serves as a brake force thus causing the yarn to form a hank. As soon as this hank is formed, the air stream can be stopped. The hank does not disentangle although the conveyor continuously withdraws, and the feed rollers continuously feed the yarn.

The reliability in operation can be additionally increased by providing the stuffer box channel with a sealing projection which projects into the wedge-shaped contour of the feed rollers.

A delivery device might be arranged between the stuffer box and the conveyor which device is, for example, a chute. It is also possible to attach a hinged forwarding channel to the exit of the stuffer box.

Other objects, advantages and novel features of the present invention will become apparent from the following detailed description of the invention when considered in conjunction with the accompanying drawings.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
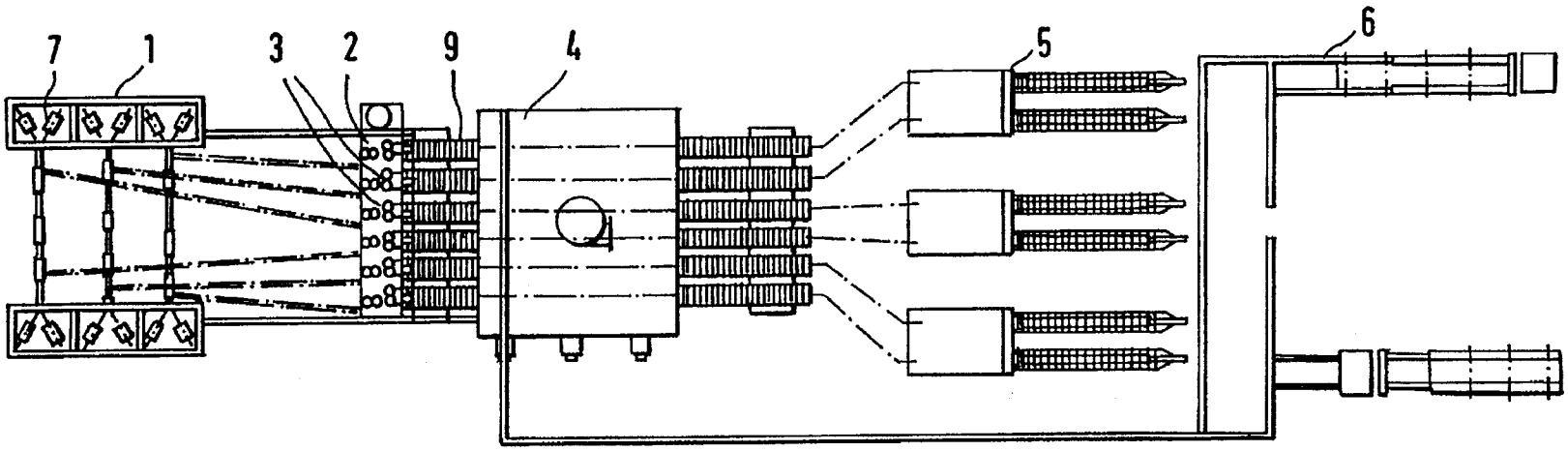
FIG. 1 is a yarn conditioning plant comprising a plurality of texturizing devices in plan view.
Figure 2:
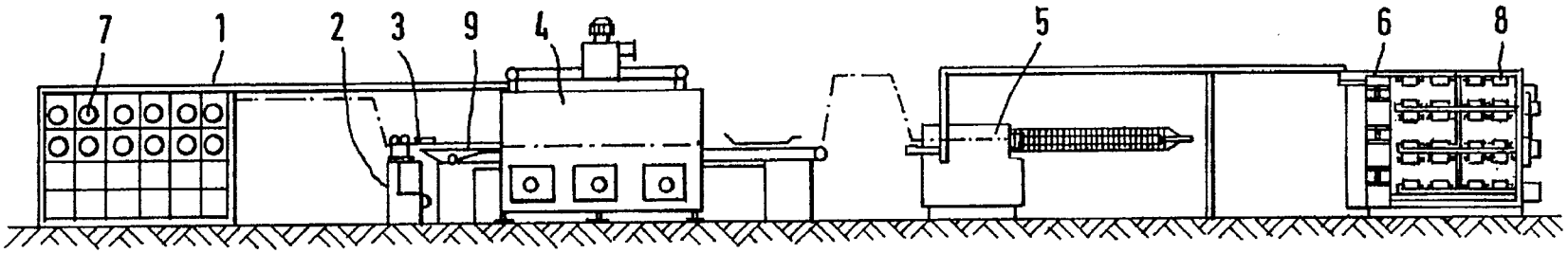
FIG. 2 is the plant in FIG. 1 in side elevation.

The yarn conditioning plant shown in FIGS. 1 and 2 is suitable for the simultaneous production of a plurality of frieze yarns. The yarn conditioning plant comprises a creel 1, a texturizing unit 2 consisting of a plurality of texturizing devices 3, a heat setting chamber 4, an accumulator 5, and a winder 6. The creel 1 has taking-up devices for several feed packages 7, from which the yarns to be texturized are withdrawn and fed to the texturizing unit 2.

Each texturizing device 3 can texturize several yarns. The crimped yarns are deposited on respective conveyors 9, which are constructed in such a way that a fluid can flow through them. At the end of the continuous process, the texturized and heat set yarns are wound onto packages 8 of the winder 6. The preceeding accumulator 5 serves the temporary storage of the yarns transported to the winder 6.

Figure 3:
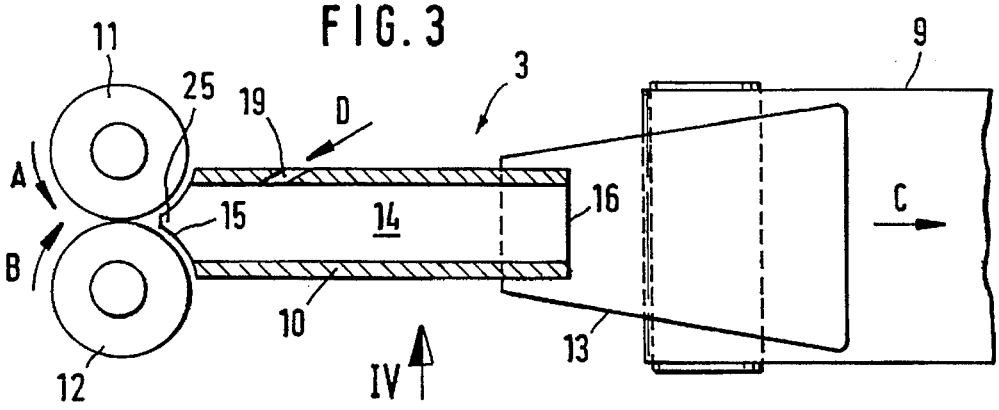
FIG. 3 is an enlarged detail of FIG. 1 in the area of the texturizing device, and partly cut.
Figure 4:
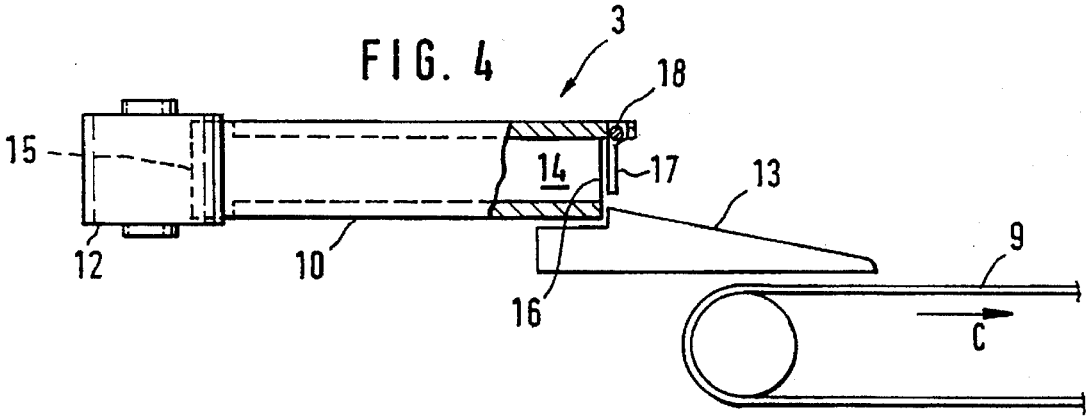
FIG. 4 is a partly cut view of the texturizing device shown in arrow direction IV of FIG. 3.

FIGS. 3 and 4 show schematically one of the texturizing devices 3 which is part of the texturizing unit 2. Each texturizing device 3 contains essentially a stuffer box 10 which will be described in more detail below; the texturizing device 3 further comprises feed rollers 11,12 driven in arrow directions A and B, a delivery device 13 arranged downstream of the stuffer box 10, and a conveyor 9 driven in arrow direction C. The circumferential speed of the feed rollers 11,12 in relation to the transport speed of the conveyor 9 is thus that the yarns to be texturized are crimped in the desired way.

The stuffer box 10 contains a stuffer box channel 14 having an inlet opening 15 and an outlet opening 16. As shown in FIGS. 3 and 4, the stuffer box channel 14 has a constant circular cross section, which is a circumferentially closed cross-section. Insignificant discrepancies from the ideal circular form do not matter.

In order to avoid any discontinuity surfaces and especially any parting lines, the stuffer box 10 is made from one piece. Thus fibers or filaments cannot accumulate at any parting lines or at the edges of the stuffer box channel 14 so that impairments of the crimping process are avoided.

It is possible to arrange a yarn retarding lid 17 in the area of the outlet opening 16; the lid 17 is pivotably attached to an axle 18. The yarn retarding lid 17 is effective against the transport direction of the crimped yarn, and is thus closed when the plant is out of operation. The retarding force may be caused either by the weight of the lid 17 or by an additional spring (not shown). Thus an undesired loosening of the crimping is avoided before the yarn has reached the heat setting chamber 4.

The delivery device 13 as shown has the shape of a chute which is sloped to the conveyor 9, and which guides the crimped yarns leaving the stuffer box channel 14 to the conveyor 9. The delivery device 13 can be constructed, if so desired, as a preferably traversing duct.

If necessary, the stuffer box 10 can contain an air inlet opening 19, which leads into the stuffer box channel 14, and which is directed against the channel inlet opening 15. An air stream can be blown through the air inlet opening 19 when the texturizing device 3 is started, which air stream brakes the yarn transport and causes the yarn to form a hank. As soon as said hank is formed, the air stream can be stopped.

Figure 5:
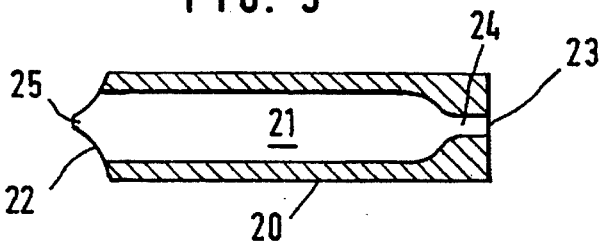
FIG. 5 is a stuffer box as shown in FIG. 3, but with a taper in the area of the channel outlet opening.

As is shown in FIG. 5, the stuffer box channel 21 may have a taper 24 in the area of the channel outlet opening 23; abrupt changes of cross section, however, should then be avoided. When such a taper 24 is provided, it is possible to omit the yarn retarding lid 17. As was the case in FIGS. 3 and 4, the stuffer box channel 21 shown in FIG. 5 may also be provided with an air inlet opening 19.

The stuffer box channels 14 and 21 are each provided with a sealing projection 25 in the area of the relevant channel inlet opening 15 or 22; the sealing projection 25 projects into the wedge-shaped contour of the feed rollers 11,12. Thus a secure change-over is created from the feed rollers 11,12 to the relevant stuffer box channel 14 or 21. If necessary, the feed rollers 11,12 may be covered on their front sides by projections of the stuffer box 10 or 20 (not shown).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A texturizing device for a yarn conditioning plant, comprising:

a pair of feed rollers for feeding at least one yarn to be crimped, a stuffer box that crimps the yarn, the stuffer box having a stuffer box channel, a channel inlet opening, and a channel outlet opening, and a conveyor for transporting the crimped yarn to a heat setting chamber, wherein the stuffer box channel has a curved circumferentially closed cross section free from any parting lines.

2. A texturizing device according to claim 1, wherein the stuffer box is made from one piece, and wherein the stuffer box channel has a predominantly constant cross section.

3. A texturizing device according to claim 2, wherein the stuffer box channel has a yarn retarding lid in an area of the outlet opening.

4. A texturizing device according to claim 2, wherein the stuffer box comprises at least one air inlet opening, which leads into the stuffer box channel, and which is directed against the channel inlet opening.

5. A texturizing device according to claim 2, wherein the stuffer box channel comprises a sealing projection which projects into a wedge-shaped contour of the feed rollers.

6. A texturizing device according to claim 2, wherein the stuffer box channel has a taper in an area of its outlet opening.

7. A texturizing device according to claim 6, wherein the stuffer box channel has a yarn retarding lid in an area of the outlet opening.

8. A texturizing device according to claim 6, wherein the stuffer box comprises at least one air inlet opening, which leads into the stuffer box channel, and which is directed against the channel inlet opening.

9. A texturizing device according to claim 6, wherein the stuffer box channel comprises a sealing projection which projects into a wedge-shaped contour of the feed rollers.

10. A texturizing device according to claim 1, wherein the stuffer box channel has a yarn retarding lid in an area of the outlet opening.

11. A texturizing device according to claim 1, wherein the stuffer box comprises at least one air inlet opening, which leads into the stuffer box channel, and which is directed against the channel inlet opening.

12. A texturizing device according to claim 11, wherein the stuffer box channel has a yarn retarding lid in an area of the outlet opening.

13. A texturizing device according to claim 1, wherein the stuffer box channel comprises a sealing projection which projects into a wedge-shaped contour of the feed rollers.

14. A texturizing device according to claim 13, wherein the stuffer box channel has a yarn retarding lid in an area of the outlet opening.

15. A texturizing device according to claim 13, wherein the stuffer box comprises at least one air inlet opening, which leads into the stuffer box channel, and which is directed against the channel inlet opening.

16. A texturizing device according to claim 1, wherein a chute is arranged between the stuffer box and the conveyor.

17. A texturizing device according to claim 16, wherein the stuffer box channel has a yarn retarding lid in an area of the outlet opening.

18. A texturizing device according to claim 16, wherein the stuffer box comprises at least one air inlet opening, which leads into the stuffer box channel, and which is directed against the channel inlet opening.

19. A texturizing device according to claim 16, wherein the stuffer box channel comprises a sealing projection which projects into a wedge-shaped contour of the feed rollers.

20. A texturizing device according to claim 16, wherein the stuffer box is made from one piece, and wherein the stuffer box channel has a predominantly constant cross section.

21. A texturizing device according to claim 16, wherein the stuffer box channel has a taper in an area of its outlet opening.

22. A texturizing device according to claim 1, wherein the stuffer box channel has a circular cross section.

* * * * *